US005096019A

United States Patent [19]

Kelsay

[11] Patent Number: 5,096,019

[45] Date of Patent: Mar. 17, 1992

[54] FOLDING SAWHORSE

[76] Inventor: Daniel G. Kelsay, 1816 Wedgemere Rd., El Cajon, Calif. 92020

[21] Appl. No.: 751,509

[22] Filed: Aug. 29, 1991

[51] Int. Cl.[5] ..... B27B 21/00; B25H 1/06

[52] U.S. Cl. ..... 182/155; 182/225; 108/132

[58] Field of Search ..... 182/155, 153, 181–186, 182/224–226; 108/131, 132, 133

[56] References Cited

U.S. PATENT DOCUMENTS

| | | | |
|---|---|---|---|
| 943,328 | 12/1909 | Whitehead . | |
| 2,396,737 | 3/1946 | Maclaskey | 182/155 |
| 2,829,927 | 4/1958 | Sword | 182/186 |
| 2,832,648 | 4/1958 | Goosmann | 182/155 |
| 3,269,487 | 8/1966 | Larson | 182/155 |
| 3,631,941 | 1/1972 | Greeman et al. | 182/155 |
| 3,682,272 | 8/1972 | Secor | 182/155 |
| 3,817,349 | 6/1974 | Barthel | 182/155 |
| 3,951,233 | 4/1976 | Meyers | 182/155 |
| 4,645,162 | 2/1987 | Roy et al. | 248/439 |
| 4,836,332 | 6/1989 | Henson | 182/155 |
| 4,967,877 | 11/1990 | Wallman et al. | 182/155 |
| 5,052,517 | 10/1991 | Wallman | 182/155 |

*Primary Examiner*—Reinaldo P. Machado
*Attorney, Agent, or Firm*—Warren F. B. Lindsley

[57] ABSTRACT

A folding trestle having a movable horizontal work surface spring biased into engagement with the top edges of a skirt. A pair of legs are mounted at each end of the skirt which force the work surface of the trestle away from the top edge of the skirt when the legs are movable to and from their extended and folded positions.

8 Claims, 2 Drawing Sheets

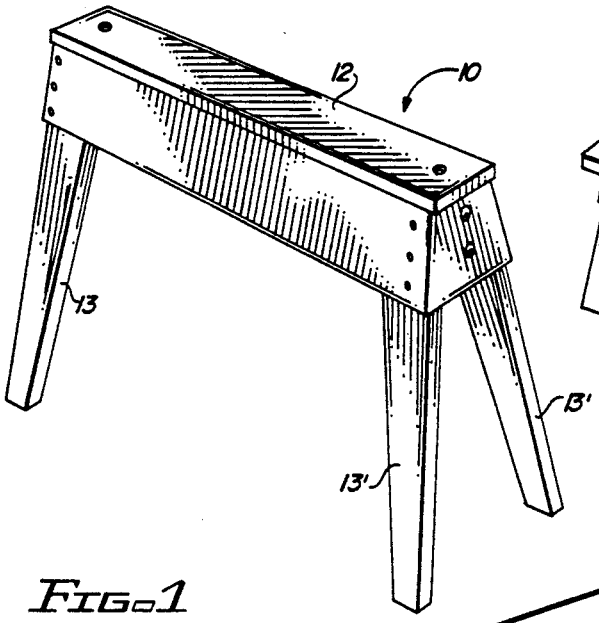
FIG. 1
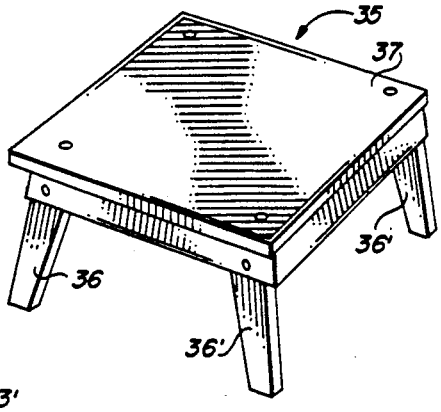
FIG. 4
FIG. 2
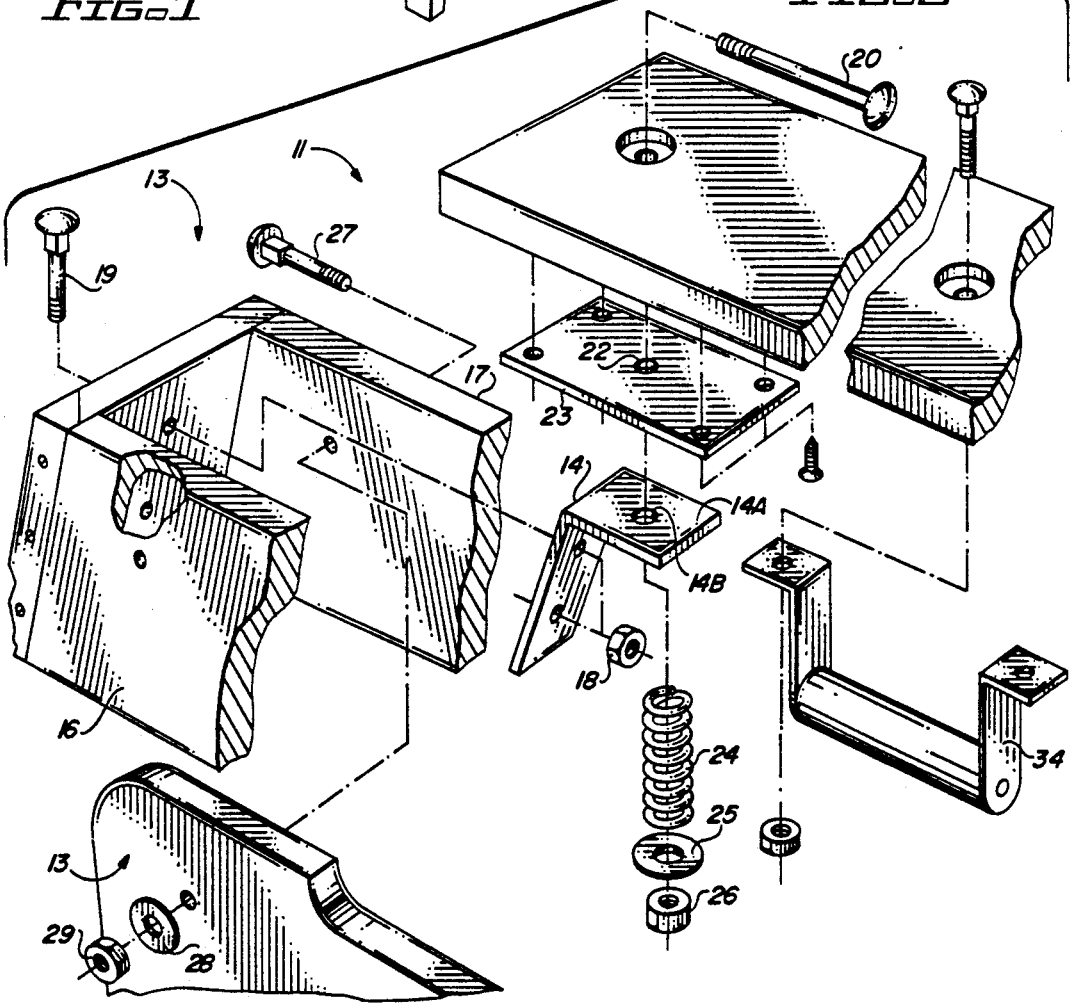

FOLDING SAWHORSE

BACKGROUND OF THE INVENTION

This invention relates to a trestle and more particularly to a collapsible sawhorse having legs which are pivotally mounted under spring pressure to swing between leg extended and leg storage positions.

DESCRIPTION OF THE PRIOR ART

U.S. Pat. No. 3,951,233 discloses a collapsible sawhorse. When the legs of the sawhorse are in the extended position, the load bearing member rests directly on the top surface of the legs.

U.S. Pat. No. 3,682,272 provides a sawhorse having legs, the inside corners of which are cut away. Due to oversize holes and the cut of the legs, the legs will clear the underside of the top member as the leg is extended and retracted.

U.S. Pat. No. 4,645,162 discloses a sawhorse having a spring locking member for a collapsible leg.

U.S. Pat. No. 2,396,737 shows a sawhorse, the legs of which fit into sockets. A slot is reinforced to prevent splitting of the leg or undue wear.

Other patents of general interest are listed below:

| | |
|---|---|
| 943,328 | 4,967,877 |
| 2,832,648 | 3,621,941 |
| 2,829,927 | 3,817,349 |
| 3,269,487 | |

None of the prior art discloses a sawhorse the legs of which provide a cam surface for moving under spring pressure the working surface of the sawhorse when the legs are moved from leg collapsed to leg extended position.

SUMMARY OF THE INVENTION

In accordance with the invention claimed a new and improved sawhorse is provided wherein the legs are firmly and securely held in supporting or folded position.

It is, therefore, one object of this invention to provide a new and improved collapsible sawhorse.

Another object of this invention is to provide an improved sawhorse the legs of which provide a cam surface for moving under spring pressure the tops or working surface of the sawhorse when the legs are moved from supporting to leg folded positions.

A further object of this invention is to provide an improved sawhorse the legs of which are easy to install and use and provides a structurally solid structure that can carry heavy loads without stressing the leg connection.

A still further object of this invention is to provide an improved sawhorse that may be constructed of wood, plastic or metal parts in an economical manner.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which:

FIG. 1 is a perspective view of a sawhorse and embodying the invention;

FIG. 2 is an exploded partial view of one corner of the sawhorse shown in FIG. 1;

FIG. 4 is a perspective view of the invention concept applied to a trestle and/or table structure.

DESCRIPTION OF THE PREFERRED EMBODIMENT

Figures 3A, 3B, 3C:
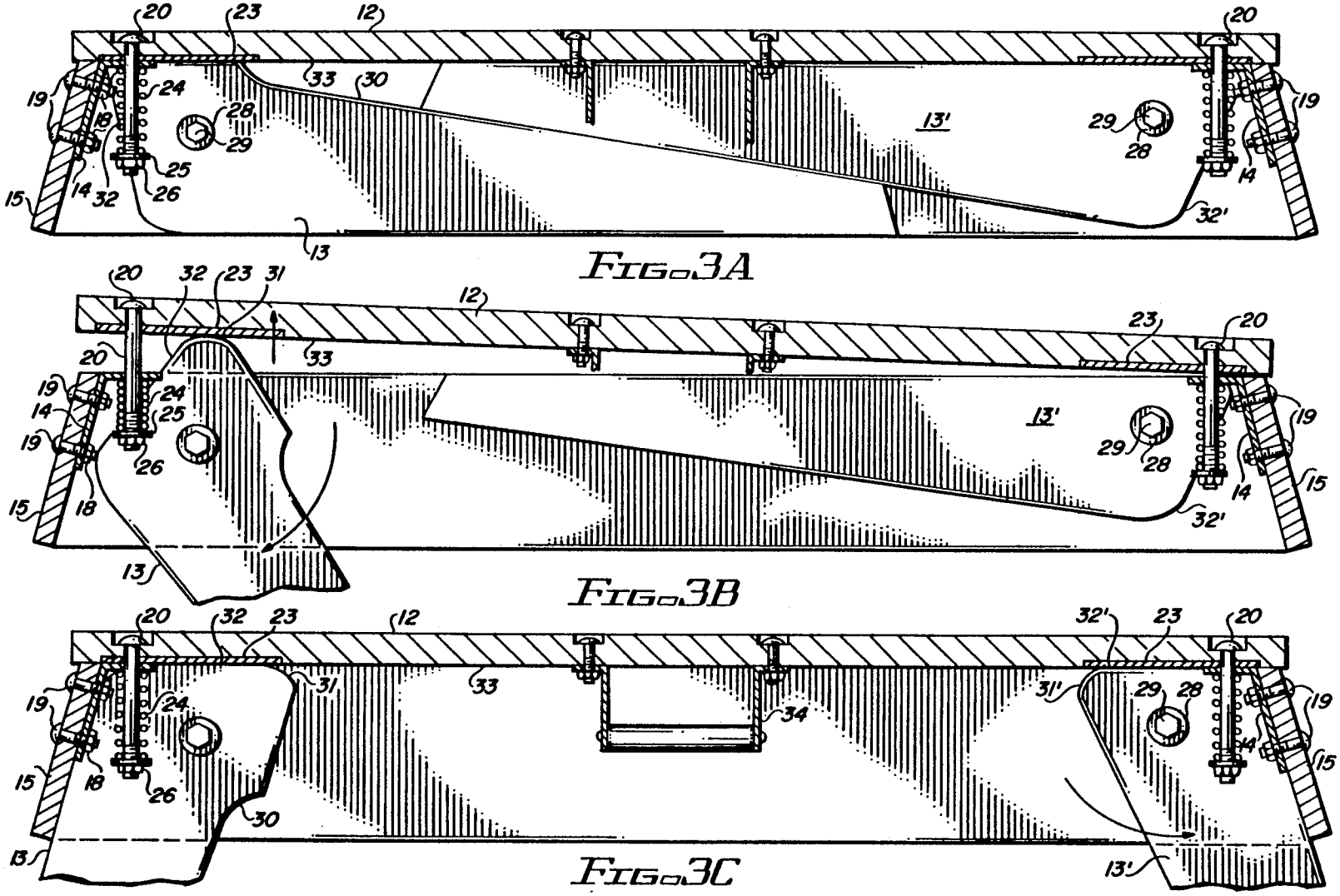
FIGS. 3A–3C are sectional views of the sawhorse shown in FIG. 1 with a leg of the sawhorse moved from its collapsed position shown in FIG. 3A to its erected or supporting position shown in FIG. 3C.

Referring more particularly to the drawings by characters of reference, FIG. 1 discloses a support member or sawhorse 10 employing a leg and bracket assembly 11 at each end thereof wherein like parts are designated by the same numerals.

The leg and bracket assemblies are secured to the under side of a top or transverse member 12 with each sub assembly being identical to each other but are oppositely disposed. In FIGS. 1 and 3A–3C, the leg members 13, 13' of the sub assemblies are shown in extended or opened positions for supporting the transverse member 12 and movable to folded or collapsed position as shown in FIG. 3A for storage or shipping purposes.

As shown in FIGS. 2 and 3A–3C, the leg and bracket assembly 11 comprises a metal bracket 14 that is secured to end 15 of transverse member 12 between sides 16 and 17 of member 12 by one or more nut and bolt means 18 and 19. The top 14A of bracket 14 is provided with an aperture 14B through which a bolt 20 extends being first passed through a shouldered aperture 21 in the top of member 12 and an aperture 22 in a metal plate 23 and then through a coil spring 24 and washer 25 for engagement with an associated nut 26.

As noted from FIGS. 3A–3C, the top or transverse member 12 is connected to end members 15 by means of a spring biasing means comprising bolt 20 and coil spring 24. Thus, member 12 can move, as shown, to and away from ends 15 of the sawhorse under the influence of leg members 13, 13'.

A pair of leg members 13, 13' are pivotally mounted on the sawhorse at each end of the structure in the manner shown in FIG. 2.

These leg members at each end of the sawhorse are each pivotally mounted on a bolt 27 that extends through apertures in one of sides 16 and 17 and the associated leg members 13 and washer 28 for threadedly engaging with a nut 29.

Thus, each leg member at one end of the sawhorse is pivotally mounted independently of the other leg member. The leg members at the opposite end of the sawhorse are each similarly mounted but contoured to nestle one within the outline 30 of the other at the other end of the sawhorse as shown in FIG. 3A.

Leg 13' pivotally mounted at the right end of the sawhorse is cradled by leg 13 pivotally mounted at the left end of the sawhorse in a common plane. The other right and left legs of the sawhorse are similarly mounted and cradled in the manner heretofore described.

FIG. 3B illustrates leg 13 being pivotally moved in a clockwise manner from the position shown in FIG. 13A to its sawhorse top supporting position shown in FIG. 3C.

As noted from FIG. 3B, the top or transverse member 12 of the sawhorse is biased upwardly against the bias of coil spring 24 by cam surface 31 of leg 13. Leg 13' and its cam surface 31' operates in a similar manner as do legs 13 but rotate counterclockwise from collapsed to erected positions. When in the leg erected position, flat surfaces 32, 32' of each of legs 13, 13' engage under spring pressure the bottom surface 33 of transverse member 12 to support member 12 in a tight stable manner.

FIG. 3C further illustrates a handle 34 secured to the bottom 33 of transverse member 12 for carrying the sawhorse when in its leg collapsed position as shown in FIG. 3A.

As shown in the drawings, the trestle or sawhorse comprises a support member or top which is horizontally positionable on top of a skirt and movable under spring pressure by legs or leg members pivotally mounted on and within the skirt. The legs are each provided with a cam surface for engaging and biasing the top away from the skirt when the legs are moved between folded positions within the skirt to extended positions and vice versa.

It should be noted that one of the two legs on each end of the skirtfolds into a common plane with one of the other of the legs at the other end of the skirt.

FIG. 4 illustrates the inventive concept as applied to table 35 with its legs 36, 36' and a top 37 being functional and containing the novel features of the sawhorse shown in FIGS. 1-3C.

It should be noted that the combination of the spring biasing means and the cam surface on each leg of the trestle lock the legs in extended and/or collapsed positions. To unlock the legs it is necessary for the user to apply force agains the biasing means of the device to move the legs from folded to extended positions or vice versa.

Although but two embodiments of the invention have been illustrated and described, it will be apparent to those skilled in the art that various changes and modifications may be made therein without departing from the spirit of the invention or from the scope of the appended claims.

What is claimed is:

1. A folding trestle comprising:

a support member, said support member comprising a movable horizontally positionable top and a vertically positionable skirt around said top, legs pivotally mounted on said skirt two adjacent to each end thereof, said legs being pivotably mounted on said skirt to swing between extended service positions and positions folded underneath said top, spring means connected between said top and said skirt for biasing said top into engagement with said skirt, said legs being provided with a cam surface for engaging and biasing said top away from said skirt when said legs are moved between folded positions and said extended service positions, and vice versa.

2. The folding trestle set forth in claim 1 wherein:

one of the two legs on each end of said skirt folds into a common plane within said skirt with the other of said legs of the other of said two legs.

3. The folding trestle set forth in claim 1 wherein:

said top comprises a table supporting surface.

4. The folding trestle set forth in claim 1 wherein:

said top comprises an elongated member biased into engagement with the top edge of said skirt.

5. The folding trestle set forth in claim 4 wherein:

said spring means comprises a coil spring extending around a bolt connected between said top and said skirt.

6. The folding trestle set forth in claim 4 wherein:

said spring means comprises a pair of coil springs one mounted at each end of said top around a bolt connected between said top and said skirt.

7. A collapsible sawhorse comprising:

a support member, said support member comprising a movable horizontally positionable elongated top and a vertically positionable skirt around said top, legs pivotally mounted on said skirt two on each end thereof, said legs being pivotably mounted on said skirt to swing between extended service positions and folded positions underneath said top and within the outline of said skirt, spring means connected between said top and said kirt for biasing said top into engagement with said skirt, said legs being provided with a cam surface for engaging and biasing said top away from said skirt when said legs are moved between folded positions and said extended positions and vice versa, and a flat surface on each of said legs for engaging the bottom of said top when in said extended service positions.

8. The collapsible sawhorse set forth in claim 7 wherein:

one of the two legs on each end of said skirt folds into a common plane with the other of said two legs at the other end of said skirt.

* * * * *